US006148538A

United States Patent [19]

Steiner et al.

[11] Patent Number: 6,148,538

[45] Date of Patent: Nov. 21, 2000

[54] CONDENSATION DEVICE AND SUCTION ELEMENT INCLUDING A CONDENSATION DEVICE

[75] Inventors: Karl Steiner, Herbrechtingen; Markus Oechsle, Bartholomä, both of Germany

[73] Assignee: Voith Sulzer Papiermaschinen GmbH, Heidenheim, Germany

[21] Appl. No.: 09/129,431

[22] Filed: Aug. 5, 1998

[30] Foreign Application Priority Data

Aug. 8, 1997 [DE] Germany ..... 197 34 372
Aug. 8, 1997 [DE] Germany ..... 197 34 373

[51] Int. Cl.[7] ..... F26B 3/08

[52] U.S. Cl. ..... 34/114; 162/204; 162/207; 34/449; 34/469; 34/115; 34/116

[58] Field of Search ..... 34/114, 115, 116, 34/117, 119, 120, 122, 123, 124, 125, 449, 448, 453, 454, 468, 469; 62/93; 162/204, 207

[56] References Cited

U.S. PATENT DOCUMENTS

| | | | |
|---|---|---|---|
| 2,448,514 | 9/1948 | Butler | 34/119 |
| 2,714,839 | 8/1955 | Mazer | 92/51 |
| 3,196,555 | 7/1965 | Friedel et al. | 34/115 |
| 4,321,757 | 3/1982 | van der Blom . | |
| 4,556,450 | 12/1985 | Chuang et al. | 34/9 |
| 4,706,391 | 11/1987 | Urbas | 34/123 |
| 5,107,919 | 4/1992 | Basseen et al. | 62/93 |
| 5,168,639 | 12/1992 | Hebles | 34/449 |
| 5,327,740 | 7/1994 | Ogasawara et al. | 62/93 |
| 5,438,765 | 8/1995 | Tyrmi et al. | 34/456 |
| 5,778,555 | 7/1998 | Lehtinen et al. | 34/71 |
| 5,950,329 | 9/1999 | Lehtinen et al. | 34/454 |

FOREIGN PATENT DOCUMENTS

| | | | |
|---|---|---|---|
| 000887718 | 12/1971 | Canada | 34/449 |
| 738801 | 10/1996 | European Pat. Off. . | |
| 2355258 | 1/1978 | France . | |
| 173728 | 3/1905 | Germany . | |
| 26 07 504 | 9/1977 | Germany . | |
| 3215042 | 11/1983 | Germany . | |
| 3532853 | 4/1986 | Germany . | |
| 3837133 | 4/1990 | Germany . | |
| 4009797 | 10/1991 | Germany . | |
| 4120261 | 1/1992 | Germany . | |
| 296 01 543 U | 1/1996 | Germany . | |
| 1401041 | 7/1975 | United Kingdom . | |
| 9711328 | 3/1997 | WIPO . | |

*Primary Examiner*—Denise L. Ferensic
*Assistant Examiner*—Michelle A. Mattera
*Attorney, Agent, or Firm*—Greenblum & Bernstein, P.L.C.

[57] ABSTRACT

Condensation device and suction element including a condensation device for machines for manufacturing and refining a fibrous material web. The condensation device includes at least one condensation element positioned in a region of at least one of steam formation and accumulation and a condensate receptacle. The suction element includes a hollow body coupled to a vacuum source. The hollow body is adapted to guide a transport belt carrying a moist and heated web. The suction element also includes at least one opening positioned to face the transport belt, at least one condensation element, and at least one condensate receptacle. The at least one condensation element and the at least one condensate receptacle are positioned within the hollow body.

18 Claims, 4 Drawing Sheets

CONDENSATION DEVICE AND SUCTION ELEMENT INCLUDING A CONDENSATION DEVICE

CROSS-REFERENCE TO RELATED APPLICATIONS

The present application claims priority under 35 U.S.C. § 119 of German Patent Application Nos. 197 34 372.4 and 197 34 373.2, filed on Aug. 8, 1998, the disclosures of which are expressly incorporated by reference herein in their entireties.

BACKGROUND OF THE INVENTION

1. Field of the Invention

The present invention relates to a condensation device for machines, e.g., paper, coating, and tissue machines, for making and refining fibrous material webs.

The present invention relates to a suction element that includes a hollow body coupled to a vacuum source. The suction element being positioned adjacent to a screen, a belt, or a felt guiding a moist and heated web, e.g., a paper, a textile or other fibrous material web, and further including at least one opening facing the web.

2. Discussion of Background Information

A condensation device has been disclosed, e.g., in DE-OS 40 09 797, wherein solvents escaping from a web condense on a rotating condensation surface. Further, in a process described in, e.g., DE-PS 38 37 133, the moist air of a paper drier is removed or diverted. The condensate developing in a subsequently positioned heat exchanger is supplied to the paper manufacturing process. It is noted that both solutions are structurally complicated and expensive.

Suction elements are utilized in machines to manufacture and to refine webs, e.g., paper webs, textile webs, or other fibrous material webs, and include a rotating roll having a perforated roll jacket, as shown in, e.g., EP 738 801 and/or DE-Gbm 29 601 543. In this regard, a suction box is coupled to a vacuum source in the roll, i.e., in accordance with EP 738 801, or outside of the roll, i.e., in accordance with DE-Gbm 29 601 543. When located outside of the roll, the vacuum source is coupled to a part of the roll periphery that is not looped by the web.

The vacuum can be utilized to guide the web to or on the suction element and/or to remove moisture from the web. Independent of this, however, a certain portion of water is always removed through the suction element together with the air. Thus, separation of the water then occurs outside of the machine, e.g., through a heat exchanger, as in DE-PS 38 37 133. Again, this arrangement is expensive and requires a correspondingly high vacuum level.

SUMMARY OF THE INVENTION

Therefore, the present invention provides a simple device for removing or diverting steam that arises in paper, coating, and tissue machines.

The present invention also provides a suction element that does not suffer from the above-noted drawbacks of the prior art.

In accordance with the present invention, at least one cooled and stationary condensation element and a condensate receptacle may be located in areas of intensified steam formation and/or accumulation. In this manner, the device is structurally simplified over the prior art arrangements, and the removal or diversion of the condensate is further simplified by the present arrangement. The condensate receptacle may be advantageously positioned underneath the condensation element, and several condensation elements may be associated with a single condensate receptacle. Thus, simple removal, and if desired, subsequent use of the condensate may be made possible via the condensate receptacle.

To guarantee the low temperature necessary for condensation of the steam on the surface of the condensation element, the condensation element includes at least one cooling channel that is flushed with a coolant, e.g., preferably water.

To simplify the construction and to ensure uniform diversion of the steam, the condensation element may be positioned to extend substantially perpendicularly to a run direction of the fibrous material web and, preferably, across its entire width. In this manner, the condensation element may be simply fastened on both sides of the fibrous material web to a support of the machine.

To intensify condensation, the condensation element includes a contoured, e.g., preferably corrugated, surface to enlarge the surface area of the element.

In an alternative arrangement, because the cooling screen, the felt or the fibrous pulp web generally move at a high velocity, at least another condensation element formed as a roll may be provided to enable direct contact with the cooling screen, the felt, or the fibrous material web. A stripping element, e.g., a scraper or doctor, positioned to contact the rotating condensation element may extend axially along the roll and can be utilized to remove the condensate from the rotating roll to the condensate receptacle.

The condensation element can be utilized in press and dryer sections of the above-named machines. In this manner, the condensation element is located in the vicinity of the heated fibrous material web and/or a heated screen or felt.

Moreover, the condensation elements can be located within a shroud that at least partially covers one area of the machine in which steam is formed and preferably removes the steam. Because the condensation occurs within the shroud, less steam is removed from the shroud.

Further, when the fibrous material web is to be heated with a heating element, a condensation element may be coupled in the web run direction, so that steam emanating from the fibrous material web condenses immediately on the condensation element and is carried away. This accelerates the drying process of the fibrous material web.

Still further, the present invention provides a suction element that includes a hollow body containing at least one cooled condensation element and an associated condensate receptacle.

In this manner, most of the water condenses within the hollow body and may be guided separately from the air suctioned out of the suction element. As a result, the entire construction of the suction element is simplified and the amount of air required to be suctioned off is reduced.

The condensation element includes a cooling channel that may be flushed with a coolant, e.g., preferably water. By providing the largest possible condensation surface for the condensation element, the utility of the condensation element can be further improved. For example, the condensation element may have a contoured, e.g., preferably corrugated, surface. In this context, it is also advantageous if several condensation elements are located in the hollow body.

As discussed above, the condensation element may be mounted in a stationary manner and the condensate receptacle may be mounted beneath the condensation element. Further, several condensation elements may be associated with a single condensate receptacle.

Generally, the hollow body may extend substantially transversely to the web and preferably across its entire width. However, for certain applications, e.g., transferring stripes to the web, the hollow body may also be positioned to limit its utility to portions of the width.

When the hollow body is mounted in a stationary manner, it may be particularly advantageous to include sliding bodies on the hollow body so that the web may be directly guided along the hollow body over the sliding bodies.

Further, in an alternative embodiment, a rotatable arrangement of the hollow body may be provided as a roll, in which the roll jacket is partially looped by the web. To suction the web, the roll jacket includes openings, e.g., holes, distributed over the roll periphery.

Suction elements as discussed herein may be utilized in dryer or press sections of machines for making or refining, e.g., paper, textile, or other fibrous material webs.

The present invention is directed to a condensation device for machines for manufacturing and refining a fibrous material web. The condensation device includes at least one condensation element positioned in a region of at least one of steam formation and accumulation and a condensate receptacle.

In accordance with another feature of the present invention, the condensate receptacle is positioned underneath the at least one condensation element.

In accordance with another feature of the present invention, the at least one condensation element includes a plurality of condensation elements and the condensate receptacle is associated with the plurality of condensation elements.

In accordance with still another feature of the present invention, the at least one condensation element includes at least one cooling channel that is to be flushed with a coolant. Further, the coolant may be water.

In accordance with a further feature of the present invention, the at least one condensation element is positioned substantially perpendicular to a web run direction. Further, the at least one condensation element may extend across an entire width of the web.

In accordance with a still further feature of the present invention, the at least one condensation element includes a contoured surface. Further, the contoured surface includes a corrugated surface.

In accordance with another feature of the present invention, a second condensation element composed of a rotatable roll is provided. The web may be guided around a portion of a periphery of the rotatable roll. Further, a stripping element may be provided to be coupled to the rotatable roll. A second condensate receptacle may be associated with the rotatable roll and the stripping element may be adapted to guide condensate into the condensate receptacle.

In accordance with still another feature of the present invention, the at least one condensation element may be arranged in one of a dryer section and press section of the machine.

In accordance with a further feature of the present invention, a shroud that at least partially covers an area for condensation may be provided. The at least one condensation element may be positioned within the shroud. Further, the shroud includes a steam removal duct.

In accordance with a further feature of the present invention, the at least one condensation element may be positioned in the vicinity of the fibrous material web in which the fibrous material web is to be heated. Further, a heating element may be positioned upstream of the at least one condensation element, the heating element being adapted to heat the fibrous material web.

In accordance with still another feature of the present invention, the at least one condensation element being positioned in the vicinity of one of a heated screen and felt.

In accordance with a still further feature of the present invention, the condensation device may include a suction element and the at least one condensation element may be positioned within the suction element. Further, the suction element includes at least one opening positioned to face a transport belt adapted to guide the fibrous material web. The suction element may be composed of a perforated roll jacket and the condensate receptacle may be positioned within the suction element. The condensation device may further include sliding elements coupled to edges of the condensate receptacle to enable slidable contact between the condensate receptacle and an interior surface of the roll jacket.

In accordance with another feature of the present invention, the machine may include one of a paper, coating, and tissue machine.

In accordance with yet another feature of the present invention, the at least one condensation element may be mounted to be stationary.

The present invention may be directed to a suction element that includes a hollow body coupled to a vacuum source. The hollow body is adapted to guide a transport belt carrying a moist and heated web. The suction element also includes at least one opening positioned to face the transport belt, at least one condensation element, and at least one condensate receptacle. The at least one condensation element and the at least one condensate receptacle are positioned within the hollow body.

In accordance with another feature of the present invention, the hollow body may extend substantially transversely to the transport belt. Further, the hollow body may extend across an entire width of the transport belt.

In accordance with still another feature of the present invention, the hollow body may be mounted to be stationary.

In accordance with yet still another feature of the present invention, the transport belt may be adapted to be guided along the hollow body and the hollow body includes sliding bodies to form contact surfaces of the hollow body against the transport belt.

In accordance with a further feature of the present invention, the hollow body may be composed of a roll having a roll jacket and may be rotatably mounted. The roll jacket may include openings distributed over a roll periphery. The transport web is guided directly along the roll.

In accordance with yet another feature of the present invention, the suction element may be adapted for use in one of a dryer section and a screen section of a machine for making or refining one of paper, textile, and other fibrous material webs.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
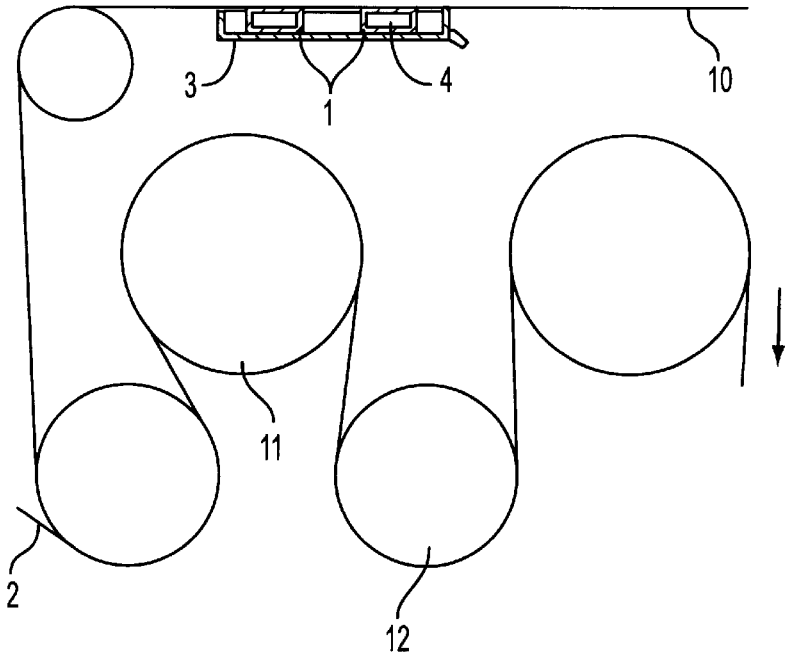
FIG. 1 illustrates a condensation element in the vicinity of a screen.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As illustrated in FIGS. 1–6, one or more cooled and stationary condensation elements 1 may be located in areas of machines for making, e.g., paper, coating, tissue, in which the intensified steam is formed and/or accumulated, e.g., in the dryer or press sections. In this manner, condensate receptacles 3, for removing or diverting the condensate to another location, may be positioned underneath condensation elements 1.

Condensation elements 1 may include at least one cooling channel 4 that may be flushed with a coolant, e.g., preferably water.

Moreover, condensation elements 1 are arranged to run transversely to the fibrous material web 2, and may extend across an entire width of web 2. Further, condensation elements 1 may include a contoured, e.g., preferably corrugated, surface to enlarge the working surface area.

Moist air condenses on the cooled condensation elements 1. The condensate then trickles off condensation elements 1 to fall into a condensate receptacle 3. Because the removed moisture reduces the humidity, drying of fibrous material web 2 is improved.

Figure 7:
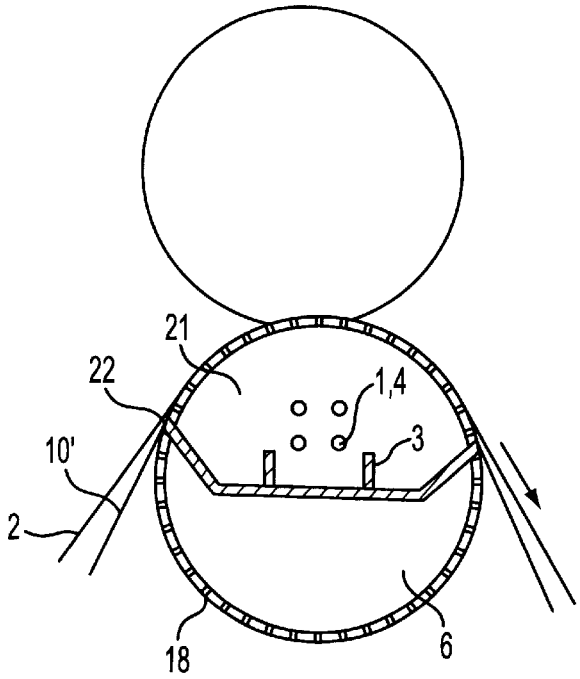
FIG. 7 illustrates a cross-section through a rotating suction element including a condensation element.
Figure 8:
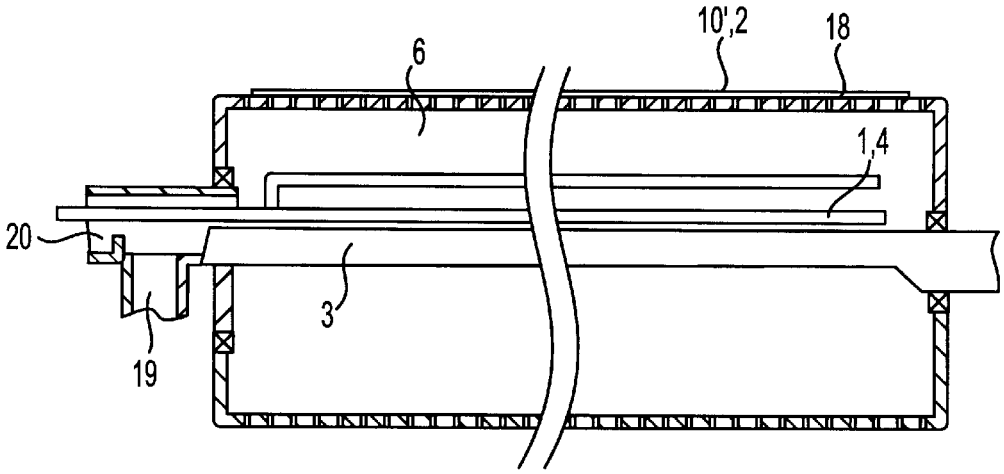
FIG. 8 illustrates a longitudinal section of the view depicted in FIG. 7.
Figure 9:
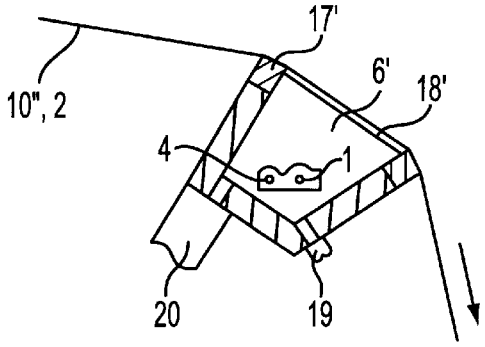
FIG. 9 illustrates a cross-section through an alternative stationary suction element.

Further, as illustrated in FIGS. 7–9, condensation elements 1 and condensate receptacles 3 may be utilized within a suction element that includes a hollow body 6 coupled to a vacuum source. Hollow body 6 may include at least one opening 18 that is positioned to face a moist and heated web 2 guided over hollow body 6. To separate the moisture from the suctioned air, at least one cooled condensation element 1 and an associated condensate receptacle 3 may be positioned within hollow body (perforated roll jacket) 6. Thus, the moisture condenses on condensation element 1 and trickles into condensate receptacle 3 to be removed or diverted to another region of the machine. In this manner, less air is suctioned, which provides a positive effect in terms of energy.

Condensation element 1 may be mounted, e.g., to be stationary, with the condensate receptacle 3 being located beneath condensation element 1. Further, condensation element 1 may be mounted, e.g., for rotation. When condensation element 1 is rotating, the condensate should be stripped from a surface of condensation element 1 and/or collected during spray-rinsing due to centrifugal force.

To enlarge the condensation surface, the condensation elements 1 may have contoured surfaces, and may include at least one cooling channel 4 that is flushed with cold water.

The suction elements are arranged to extend transversely to, and across the entire width of, web 2.

FIG. 1 shows a portion of a dryer section in which fibrous material web 2 and screen 10 are alternatingly guided over heated dryer cylinders 11 and guide rolls 12. During calefaction (heating) of fibrous material web 2 on dryer cylinder 11, steam collects in a region of a recirculation leg of screen 10. This steam may be condensed on condensation elements 1, and the condensate may be collected in a condensate receptacle 3 associated with condensation elements 1.

Figure 2:
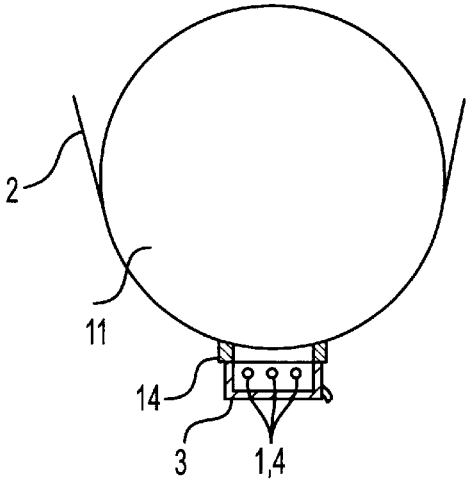
FIG. 2 illustrates a condensation element in the vicinity of a fibrous material web.

In FIG. 2, fibrous material web 2 is guided alone over heated dryer cylinder 11. Underneath dryer cylinder 11, several condensation elements 1, e.g., in the form of pipes, may be positioned near the belt wrap of fibrous material web 2. Condensate receptacle 3 may be associated with each of the several condensation elements 1, and may include sliding bodies 14, e.g., ceramic elements, to maintain sliding contact between condensate receptacle 3 and the surface of the fibrous material web 2 without any substantially negative influence.

Figure 3:
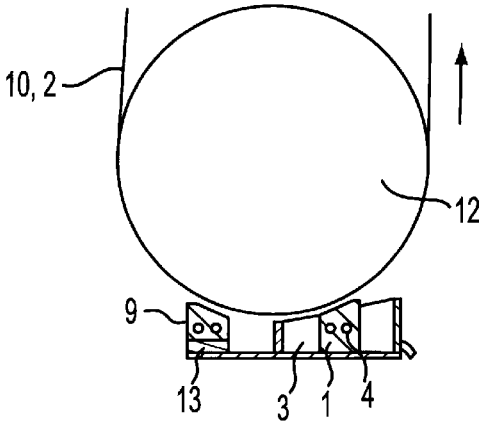
FIG. 3 illustrates a condensation element positioned subsequent to a heating element.

FIG. 3 illustrates fibrous material web 2 being guided via screen 10 over a guide roll 12. In accordance with this exemplary embodiment, fibrous material web 2 may be positioned outside screen 10, and guide roll 12 may be a suction roll. A heating element 9 may be positioned in the belt wrap area of guide roll 12 to heat fibrous material web 2.

The use of heating element 9 adjacent fibrous material web 2 forms steam via the calefaction. Accordingly, condensation element 1 may be coupled with two cooling channels 4 arranged to extend transversely to the web run direction in the belt wrap area. Condensate receptacle 3 may be coupled with heating element 9 through an insulating element 13.

Figure 4:
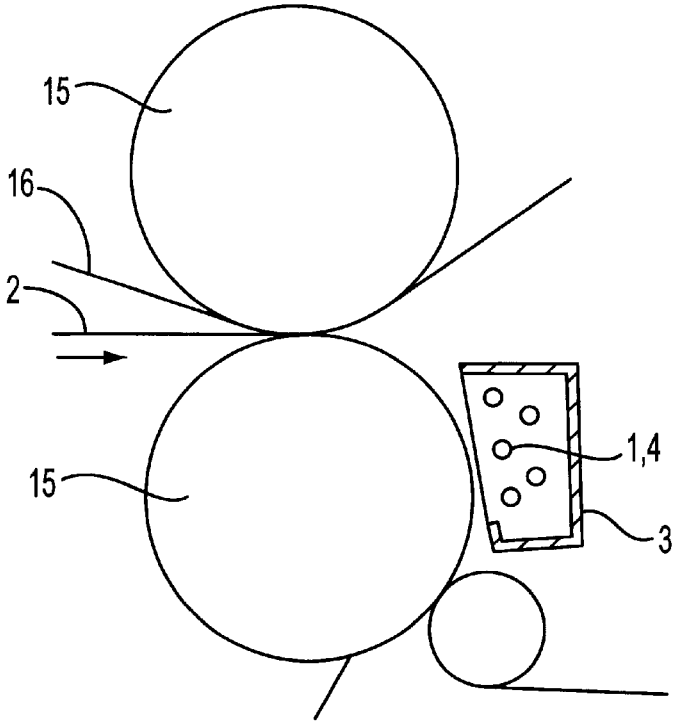
FIG. 4 illustrates a condensation element in a press section.

FIG. 4 shows at least one portion of a press section in which fibrous material web 2 is guided through a press nip formed between two press rolls. Material web 2 is guided through the press nip with a felt 16 for dewatering or draining material web 2. In this manner, the continuous felt 16 may be positioned above fibrous material web 2 and lower press roll 15 may be a heated roll. After the press nip, fibrous material web 2 adheres to the surface of heated lower press roll 15 before being guided to a subsequent processing area of the machine. As fibrous material web 2 is in contact with heated lower press roll 15, steam may be formed. Accordingly, at least one condensation element 1, e.g., pipes, may be positioned in the area following the press nip. A condensate receptacle 3 may be associated with the condensation element(s) 1, and include an opening facing fibrous material web 2.

Figure 5:
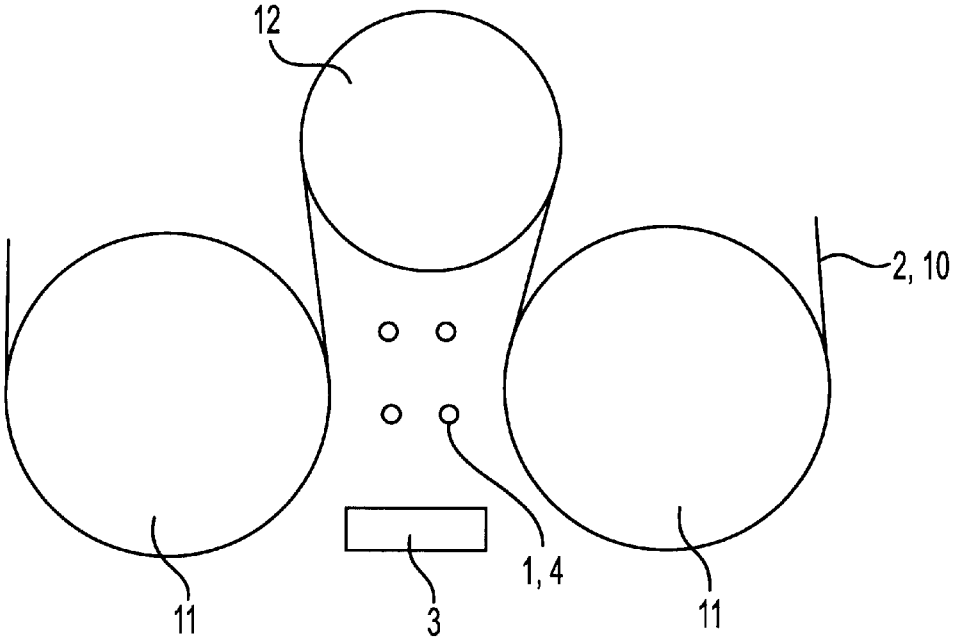
FIG. 5 illustrates a condensation element in a dryer section.

In FIG. 5, a portion of a dryer section is depicted in which fibrous material web 2 is guided with screen 10 in an alternating manner over heated dryer cylinders 11 and guide rolls 12. Dryer cylinders 11 may be arranged in a row underneath guide rolls 12. In this embodiment, condensation elements 1 are located with condensate receptacle 3 in a chamber or region between dryer cylinders 11 and underneath guide roll 12. In this region, evaporation of moisture in fibrous material web 2 occurs through screen 10.

Figure 6:
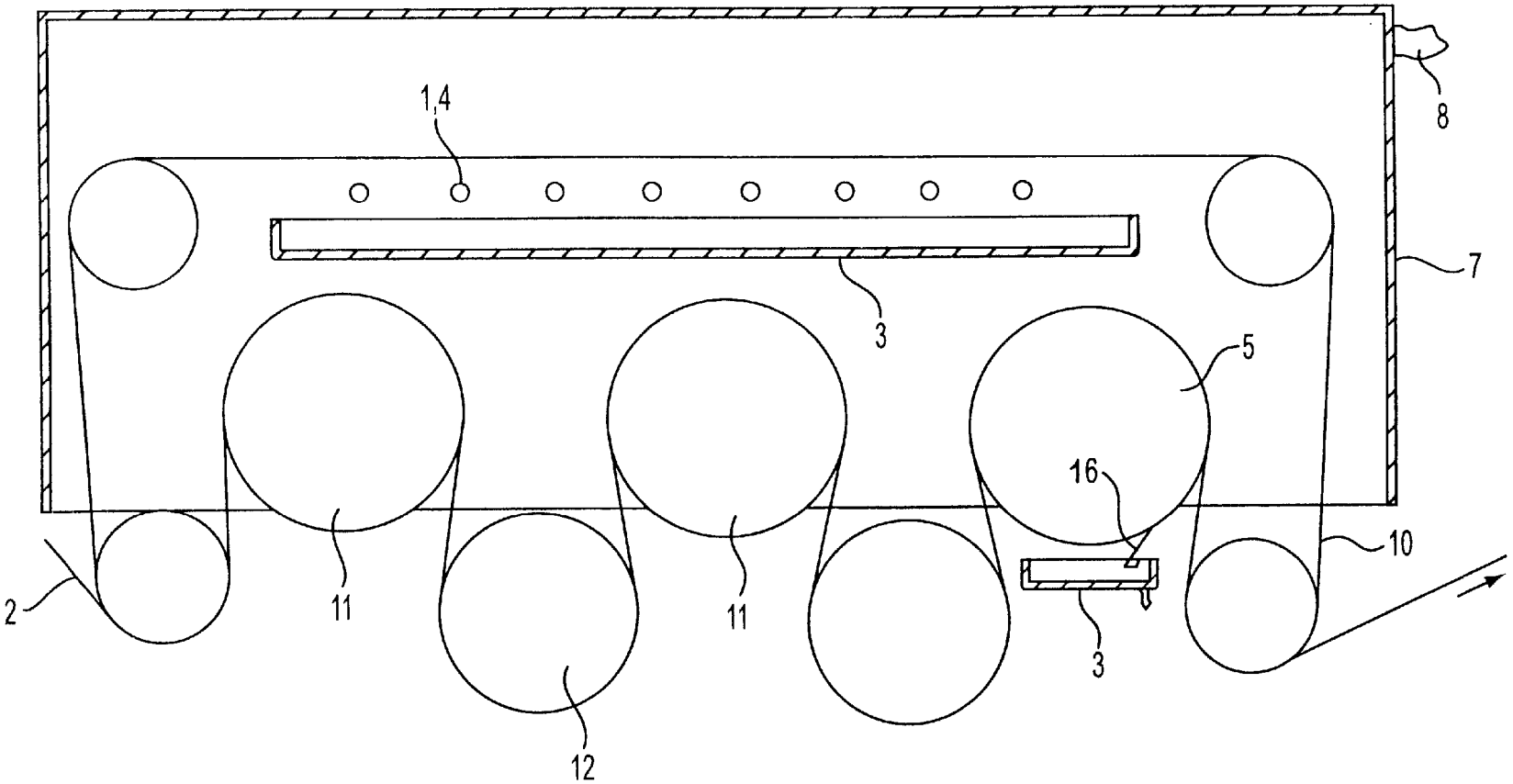
FIG. 6 illustrates a stationary and rotating condensation element in a dryer section having a shroud.

In the embodiment shown in FIG. 6, a dryer group is depicted in which screen 10 alternatingly guides fibrous material web 2 over heated dryer cylinders 11 and guide rolls 12. In this embodiment, dryer cylinders 11 are disposed above guide rolls 12.

The dryer group may be covered by a shroud 7 that removes, e.g., through a removal duct 8, at least a part of the steam formed in the dryer group by contact between the moist web and the dryer cylinders. This removal of steam, by reducing humidity, positively influences the drying process. Further, condensation elements 1 may be mounted under a recirculation leg of continuous screen 10 and further may be associated with common condensate receptacle 3. Moreover, the last dryer cylinder may be replaced with a cooled condensation element 5 formed as, e.g., a roll. The moisture within fibrous material web 2 condensing on roll 5 may be guided along the outside surface, i.e., outside of the belt wrap area, and may be stripped off the surface via a stripping element 16, e.g., a scraper or doctor, into condensate receptacle 3. Thus, in addition to improved drying, this embodiment reduces of amount of steam to be removed from the shroud.

In the embodiment depicted in FIGS. 7 and 8, the condensation elements may be arranged within a suction element to be utilized in, e.g., a press section to dewater or drain fibrous material web 2.

In this regard, moist and heated fibrous material web 2 may be guided together with a drainage felt 10' through a press nip formed between, e.g., a press roll and a suction element. The suction element may be a suction roll that includes a rotating perforated roll jacket 6. The fluid pressed out of fibrous material web 2 in the press nip and into drainage felt 10' is suctioned into an interior of roll jacket 6 along with suctioned air through openings 18 in roll jacket 6. Within roll jacket 6, the moisture can condense on condensation elements 4, and the condensate may be collected in condensate receptacle 3 that is positioned to remove or drain the condensate toward escape 19. The interior of roll jacket 6 may be coupled to a vacuum source via a duct 20. To limit the amount of suctioned air, suctioned chamber 21 within roll jacket 6 may be delimited by seals 22 positioned in a vicinity of the area of roll jacket 6 looped by fibrous material web 2.

Two condensation elements 1, which may be positioned within roll jacket 6, may be in the form of, e.g., pipes having a coolant, e.g., water, flowing therethrough. In this manner, a common condensate receptacle 5 may be associated to both condensation elements 1.

In FIG. 9, a stationary suction element 6' is illustrated. A fibrous material web 2 may be guided over a large opening 18' in suction element 6' on a transport belt 10", e.g., a dryer screen. In this manner, a travel path of the web may be diverted and moisture may be removed from dryer screen 10".

Suction element 6' includes sliding bodies 17', e.g., ceramic elements, positioned on opposite sides of large opening 18' to contact dryer screen 10". In the suctioned interior of suction element 6', condensation element 1 may include cooling channels 4. Further, collected condensate may be removed or transported out of suction element 6' via escape 9 in the condensate receptacle 5. A vacuum source may be coupled to suction element 6' via a duct 20.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A condensation device for machines for manufacturing and treating a fibrous material web comprising:

at least one heating element positioned in a vicinity of the fibrous material web, wherein the at least one heating element is adapted to heat the fibrous material web, and whereby at least one of steam formation and accumulation arises;

at least one condensation element positioned downstream of the heated element, relative to a web run direction, and in a region of the at least one of steam formation and accumulation; and a condensate receptacle, wherein the at least one condensation element and the condensate receptacle are arranged as an open system and located within an open area of the machine.

2. The condensation device in accordance with claim 1, the condensate receptacle being positioned underneath the at least one condensation element.

3. The condensation device in accordance with claim 1, the at least one condensation element comprising a plurality of condensation elements; and the condensate receptacle being associated with the plurality of condensation elements.

4. The condensation device in accordance with claim 1, the at least one condensation element comprising at least one cooling channel that is to be flushed with a coolant.

5. The condensation device in accordance with claim 4, the coolant being water.

6. The condensation device in accordance with claim 1, the at least one condensation element being positioned substantially perpendicular to a web run direction.

7. The condensation device in accordance with claim 6, the at least one condensation element extending across an entire width of the web.

8. The condensation device in accordance with claim 1, the at least one condensation element comprising a contoured surface.

9. The condensation device in accordance with claim 8, the contoured surface comprising a corrugated surface.

10. The condensation device in accordance with claim 1, further comprising a second condensation element composed of a rotatable roll, wherein the web is guided around a portion of a periphery of the rotatable roll.

11. The condensation device in accordance with claim 10, further comprising a stripping element coupled to the rotatable roll;

a second condensate receptacle associated with the rotatable roll; and the stripping element being adapted to guide condensate into the condensate receptacle.

12. The condensation device in accordance with claim 1, the at least one condensation element being arranged in one of a dryer section and press section of the machine.

13. The condensation device in accordance with claim 1, further comprising a shroud that at least partially covers an area for condensation; and the at least one condensation element being positioned within the shroud.

14. The condensation device in accordance with claim 13, the shroud comprising a steam diversion duct.

15. The condensation device in accordance with claim 1, wherein the heating element is adapted to directly heat the fibrous material web.

16. The condensation device in accordance with claim 1, wherein the heating element is positioned to directly heat one of a heated screen and felt adapted to guide the fibrous material web through the machine, whereby the fibrous material web is indirectly heated by the at least one heating element.

17. The condensation device in accordance with claim 1, the machine comprising one of a paper, coating, and tissue machine.

18. The condensation device in accordance with claim 1, the at least one condensation element being mounted to be stationary.

* * * * *